US011056776B2

(12) United States Patent
Reichardt et al.

(10) Patent No.: US 11,056,776 B2
(45) Date of Patent: Jul. 6, 2021

(54) ANTENNA ARRANGEMENT FOR A VEHICLE

(71) Applicant: AUDI AG, Ingolstadt (DE)

(72) Inventors: Lars Reichardt, Wettstetten (DE); Amir Cenanovic, Hepberg (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 16/635,821

(22) PCT Filed: Jul. 18, 2018

(86) PCT No.: PCT/EP2018/069478
§ 371 (c)(1),
(2) Date: Mar. 31, 2020

(87) PCT Pub. No.: WO2019/025185
PCT Pub. Date: Feb. 7, 2019

(65) Prior Publication Data

US 2020/0227815 A1 Jul. 16, 2020

(30) Foreign Application Priority Data

Aug. 2, 2017 (DE) ..... 102017213374.0

(51) Int. Cl.
*H01Q 1/32* (2006.01)
*H01Q 5/307* (2015.01)
(Continued)

(52) U.S. Cl.
CPC ..... *H01Q 1/3291* (2013.01); *H01Q 1/1271* (2013.01); *H01Q 5/307* (2015.01); *H01Q 5/50* (2015.01)

(58) Field of Classification Search
CPC ..... H01Q 1/3291; H01Q 1/1271; H01Q 5/50; H01Q 5/307
(Continued)

(56) References Cited

U.S. PATENT DOCUMENTS 5,659,324 A * 8/1997 Taniguchi ..... H01Q 1/1278 343/713
6,121,934 A * 9/2000 Taniguchi ..... H01Q 1/1278 343/704
(Continued)

FOREIGN PATENT DOCUMENTS

CN 102714344 A 10/2012
CN 102714356 A 10/2012
(Continued)

OTHER PUBLICATIONS

International Search Report and Written Opinion of the International Searching Authority directed to related International Patent Application No. PCT/EP2018/069478, with attached English-language transation, dated Oct. 12, 2018; 18 pages.
(Continued)

*Primary Examiner* — Lam T Mai
(74) *Attorney, Agent, or Firm* — Sterne, Kessler, Goldstein & Fox P.L.L.C.

(57) ABSTRACT

The present invention relates to an antenna arrangement for a vehicle, in which a first antenna structure is arranged in a housing of an impedance converter and a second antenna structure is arranged in or on a vehicle pane.

13 Claims, 1 Drawing Sheet

(51) Int. Cl.
*H01Q 5/50* (2015.01)
*H01Q 1/12* (2006.01)

(58) Field of Classification Search
USPC ..... 343/713
See application file for complete search history.

(56) References Cited

U.S. PATENT DOCUMENTS

| | | | | |
|---|---|---|---|---|
| 6,417,810 | B1 | 7/2002 | Huels et al. | |
| 6,593,889 | B1 * | 7/2003 | Raddant | H01Q 1/1271 343/704 |
| 6,603,435 | B2 | 8/2003 | Lindenmeier et al. | |
| 10,700,412 | B2 * | 6/2020 | Cenanovic | H01Q 1/3291 |
| 2003/0058178 | A1 | 3/2003 | Von Alpen et al. | |
| 2005/0057402 | A1 * | 3/2005 | Ohno | H01Q 21/0075 343/700 MS |
| 2012/0256798 | A1 | 10/2012 | Paulus et al. | |
| 2012/0268332 | A1 | 10/2012 | Guan et al. | |
| 2012/0274519 | A1 | 11/2012 | Chakam et al. | |
| 2013/0093572 | A1 * | 4/2013 | Bloy | H01Q 21/245 340/10.4 |
| 2013/0252661 | A1 | 9/2013 | Holz et al. | |
| 2014/0035774 | A1 * | 2/2014 | Khlifi | G01S 13/0209 342/21 |
| 2015/0171510 | A1 * | 6/2015 | Hirose | H01Q 1/3291 343/713 |
| 2019/0020115 | A1 * | 1/2019 | Reichardt | H01Q 13/10 |
| 2019/0267703 | A1 * | 8/2019 | Koch | G01S 13/931 |

FOREIGN PATENT DOCUMENTS

| | | | |
|---|---|---|---|
| CN | 103125082 | A | 5/2013 |
| CN | 110537290 | A | 12/2019 |
| DE | 19925127 | C1 | 11/2000 |
| DE | 10002777 | C1 | 8/2001 |
| DE | 10114769 | A1 | 10/2002 |
| DE | 10314094 | A1 | 3/2004 |
| DE | 69926826 | T2 | 3/2006 |
| DE | 102009051605 | A1 | 3/2006 |
| DE | 202013007872 | U1 | 10/2013 |
| EP | 2506364 | A1 | 10/2012 |
| KR | 20120068102 | A | 6/2012 |

OTHER PUBLICATIONS

International Preliminary Report on Patentability of the International Searching Authority directed to related International Patent Application No. PCT/EP2018/069478, with attached English-language transation, completed Sep. 23, 2019; 14 pages.

* cited by examiner

ANTENNA ARRANGEMENT FOR A VEHICLE

TECHNICAL FIELD

The present invention relates to an antenna arrangement for a vehicle, in which a first antenna structure is arranged in a housing of an impedance converter and a second antenna structure is arranged in or on a vehicle pane.

BACKGROUND

Due to new services and increasing demands on the quality and data rate of wireless services, the number of antennas to be installed in vehicles is constantly increasing. In addition to the positioning of antennas in the area of the bumper and on the roof, the pane area of vehicles offers a potential installation space for antennas. Here, underglass antennas, such as those in the area of the mirror base holder or in the area of the rear pane, or foil adhesive solutions are currently known.

DE 103 14 094 A1 discloses a vehicle antenna mounted on a pane and having an integrated amplifier circuit, wherein the antenna allows use for both mobile radio services and broadcasting services.

DE 699 26 826 T2 discloses a pane antenna arrangement for a vehicle. The transmitting and receiving apparatus of the vehicle comprises a pane antenna for mobile radio and broadcasting as well as an impedance converter.

DE 101 14 769 A1 discloses an active broadband reception antenna. The pane antenna for a vehicle comprises an amplifier circuit.

DE 10 2009 051 605 A1 relates to a multiband fin antenna for a vehicle. The multiband fin antenna has at least one transmitting and one receiving antenna element from the group AM/FM antennas, telephone and RKE antennas, GPS antenna, SDARS antenna, stacked patch antenna, DAP antennas, WLAN antenna, WIMAX antenna or DRM antenna. The antenna elements are arranged under a common fin-shaped outer cover on the outside of the vehicle. Inside the fin-shaped outer cover is an antenna circuit board on which the antenna elements are arranged. Electronic matching or amplifier circuits with transceiver, tuner or receiver are arranged on both the top and bottom of the antenna circuit board.

The arrangement of telephone antennas in a vehicle is subject to various difficulties. An arrangement of a telephone antenna on the roof of the vehicle is visible and problematic with regard to an overall impression of the vehicle. An implementation of the telephone antenna in a dashboard of the vehicle can have a high attenuation potential and cause interference with the installed electronic components. In the area of a bumper of the vehicle, a telephone antenna must be constructed particularly robust and protected and is therefore expensive. The low installation position can have a negative effect on the receiving power of the telephone antenna. In addition, telephone antennas and television antennas can interfere with each other due to partial overlaps in the frequencies used.

BRIEF DESCRIPTION OF THE DRAWINGS/FIGURES

DETAILED DESCRIPTION

Figure 1:
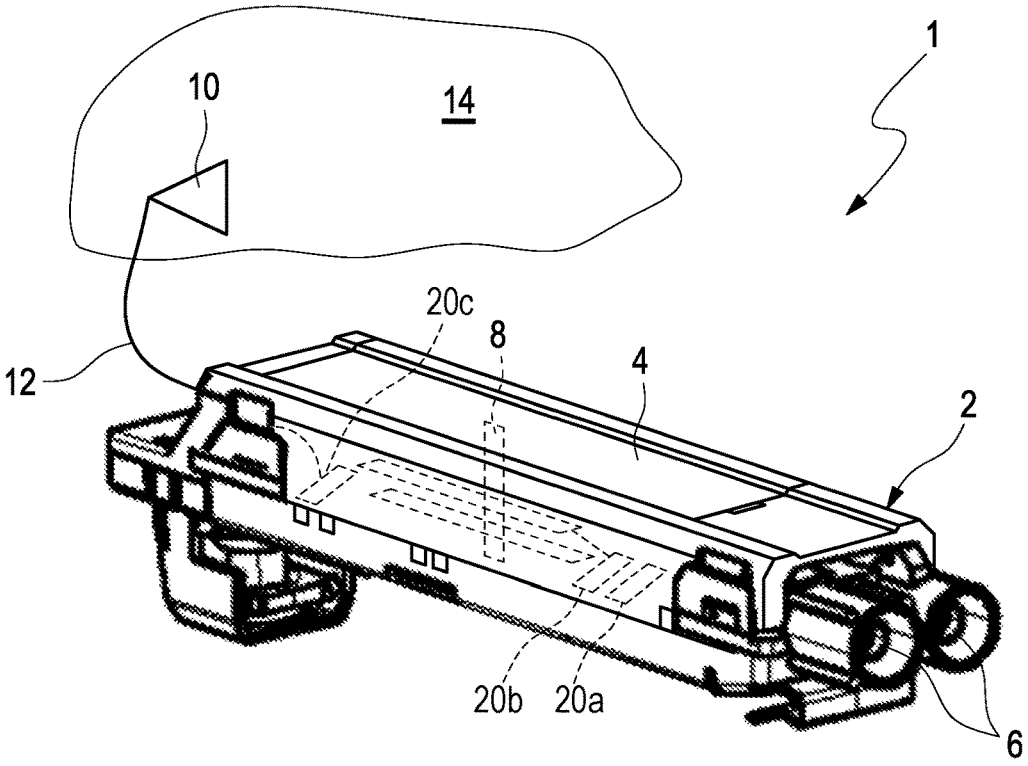
FIG. 1 illustrates a schematic representation of an antenna arrangement, according to some embodiments of this disclosure.

The aim of the invention is therefore to provide an antenna structure for arrangement in and/or on a vehicle, which offers better performance and partly uses already existing component structures, so that the antenna structure can be implemented as space-saving and cost-effective as possible.

One object of the present invention is an antenna arrangement, especially for a vehicle. The antenna arrangement has at least one second electronic circuit, at least one first antenna structure, at least one third electronic circuit, at least one second antenna structure and at least one impedance converter. The impedance converter has a housing. In the housing of the impedance converter at least one first electronic circuit for passive or active matching of an impedance and for amplifying a signal of a broadcast antenna with at least one electrical input and at least one electrical output is inserted. According to the invention, the at least one second electronic circuit for connecting to the at least one first antenna structure for transmitting and receiving data and the at least one third electronic circuit for connecting to the at least one second antenna structure for transmitting and receiving data are arranged in the housing.

The impedance converter is usually located near the area of the instruments of a vehicle and is connected to an antenna for providing broadcasting services. The antenna for providing broadcasting services is usually arranged outside of the vehicle in a roof area and is thus spaced from the impedance converter. By inserting an antenna into or onto the housing of the impedance converter, another antenna can be integrated into the vehicle in such a way that negative interactions of the antennas on both sides are minimal. The antenna arranged in or on the housing can, for example, be an antenna for providing a car-to-car communication connection, a Bluetooth antenna, a WLAN antenna and the like.

The implementation of a first antenna structure in an already existing impedance converter does not require any additional installation space in the vehicle. For the first antenna structure the already present housing of the impedance converter can be used. The small distance between the second electronic circuit and the first antenna structure, which are both integrated in the housing of the impedance converter, also prevents transfer losses and increases the performance of the first antenna structure.

A television antenna can interfere negatively with mobile phone antennas, such as LTE antennas. Due to the antenna arrangement according to the invention, it is possible to do without one or more analog television antennas on a vehicle pane and to use the resulting space for at least one mobile radio antenna on the vehicle pane (for example for UMTS, LTE, 5G services). This opens up more possibilities, as television and many other services beyond TV can also be provided via mobile phone antennas. Negative interactions between the different antenna structures, for example between a television and a mobile phone antenna, can be excluded.

In an embodiment of the antenna arrangement, the at least one second antenna structure is arranged on or in a vehicle pane. Such an arrangement of the second antenna structure has proven to be advantageous because the pane of a vehicle offers a larger surface area and thus many possibilities for attaching or integrating the antenna structure. For example, more powerful antennas with larger dimensions can be used, allowing certain receiving characteristics to be optimized. The second antenna structure can be designed as a continuous structure, such as a film, or as a structure of thin wires and thus not perceptible to a driver.

In a further embodiment, the at least one first antenna structure and the at least one second antenna structure are adaptable to different frequencies. This enables the adaptation of the first and second antenna structure to different frequencies. In this way, different frequency ranges can be covered by the different antenna structures and spaced apart locally. Due to the spatial spacing of the first and second antenna structures from each other and due to the different frequency range covered by the respective antenna structures, negative interactions between the antenna structures or antennas can also be prevented.

According to a further embodiment of the antenna arrangement according to the invention, the at least one first antenna structure receives high frequencies and the at least one second antenna structure receives low frequencies. For example, the second antenna structure can be designed for low frequencies, such as less than 1 GHz, and arranged on the pane of the vehicle. For low frequencies, it can be advantageous to design the antenna structure larger in order to optimize its receiving characteristics. The arrangement in a pane area of the vehicle provides the necessary room for enlarging the antenna structure. The pane area can be, for example, a rear pane or at least one side pane of the vehicle. Since the second antenna structure covers a different frequency range than the first antenna structure, both antenna structures can be operated side by side without any influence of the antenna structures or antennas on each other.

According to another embodiment, the at least one third circuit is connected to the at least one second antenna structure via at least one electrical line. The impedance converter can preferably be spaced away from the second antenna structure. The construction is thereby analogous to the existing broadcasting systems. A ground connection is made via the housing of the impedance converter. The second antenna structure, for example arranged on a pane, is connected to the housing of the impedance converter via a cable, for example a so-called pigtail cable. The cable has a non-negligible influence for high frequencies, which, however, is negligible at low frequencies. Thus the installation position of the first and second antenna structures can be optimized by the antenna structure according to the invention in accordance with the desired frequencies or frequency ranges to be received.

According to another embodiment of the antenna arrangement, the at least one first antenna structure and the at least one second antenna structure are radio antennas. Preferably, the first antenna structure is used for establishing a WLAN connection or a Bluetooth connection and the second antenna structure for mobile radio such as GSM, UMTS, LTE, 5G and the like. Different antennas take over different frequency ranges. As a result, the antennas are optimally controllable and can be set to the respective frequencies. Due to the spacing of the first and second antenna structures, mutual influences due to possible destructive interference can also be prevented.

According to another embodiment of the antenna arrangement, the at least one second antenna structure is integrated as a film in areas in a pane or in a body part of a vehicle. For receiving low frequencies, antenna structures on the vehicle pane in the form of a silver print, for example, are suitable.

The film can be integrated into the pane during the manufacturing process. During the integration of the antenna structure into the car body, for example, an antenna structure can be inserted into a casting mold during a manufacturing process of plastic parts. With metallic body parts, the second antenna structure can be integrated in an area parallel to a paint finish.

According to another exemplary embodiment of the antenna arrangement, the at least one second antenna structure is arranged as a film in areas on a pane or on a body part of the vehicle. The pane can be, for example, a front pane, a rear pane or a side pane of the vehicle. The front pane or a rear pane offers a large area for the attachment or integration of the second antenna structure, which offers many possibilities of arrangement. In addition, similar structures and cabling are often already present which can be used for the arrangement of the second antenna structure.

Alternatively or additionally the second antenna structure can be glued or melted on afterwards. This also enables the retrofitting of vehicles.

According to a further embodiment of the invention, the second electronic circuit and the at least one first antenna structure are arranged on the first electronic circuit of the impedance converter. This enables the impedance converter to be extended directly by the antenna and its control. By using SMD components and an optimization of the packing density on a circuit board of the impedance converter, an additional antenna and a corresponding transceiver can be arranged with the electronic components of the impedance converter on a common circuit board.

According to a further embodiment of the invention, the at least one first antenna structure is arranged outside the housing of the impedance converter. As a result, the antenna structure can, for example, be designed as a film, wrapped around the housing of the impedance converter or secured to it. This increases the performance of the at least one first antenna structure, as there is no need for attenuation by the housing.

According to another advantageous embodiment of the invention, the at least one first antenna structure is integrated into the wall of the housing of the impedance converter. Due to this, the first antenna structure can be integrated into the housing of the impedance converter during the manufacturing of the housing. For example, the antenna structure can be inserted into an injection mold before injecting a plastic material for manufacturing of the housing. In particular, the required installation space can be further reduced.

According to another advantageous embodiment of the invention, the at least one impedance converter is arranged in a front area of the vehicle or in a rear area of the vehicle. This enables an optimized installation position of the impedance converter in a vehicle. In particular, by such a positioning of the impedance converter a loss-minimized communication connection to neighboring vehicles, data services, mobile radio services and the like can be realized.

Figure 2:
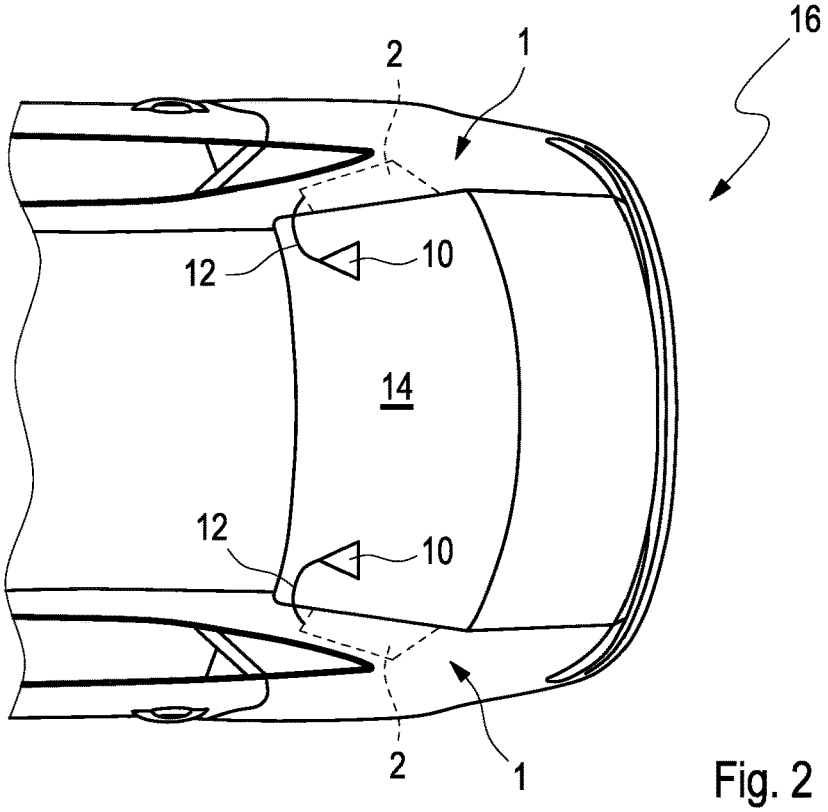
FIG. 2 illustrates a schematic plan view of a vehicle with two antenna arrangements, according to some embodiments of this disclosure.

In the drawings, the invention is depicted schematically by means of embodiments and shall be further described with reference to the drawings. In the drawings:

FIG. 1 is a schematic representation of an antenna arrangement according to an embodiment of the invention;

FIG. 2 is a schematic plan view of a vehicle with two antenna arrangements according to the invention;

FIG. 1 shows a schematic representation of an antenna arrangement 1 according to an embodiment of the invention. The antenna arrangement 1 has an impedance converter 2. The impedance converter 2 is arranged in a housing 4 and can be electrically conductively connected to other components via plug connections 6. A first antenna structure 8 is integrated into the housing 4 of impedance converter 2. In addition to the electronic circuit 20*a* of the impedance converter, in the housing 4 of the impedance converter 2, a second electronic circuit 20*b* for operating the integrated first antenna structure 8 and a third electronic circuit 20*c* for operating a second antenna structure 10 arranged outside the housing 4 are inserted. For the sake of clarity, the electronic circuits 20*a*-20*c* integrated in the housing 4 are represented schematically. The second antenna structure 10 is connected to the third electronic circuit 20*c* via an electrical line 12 and is here exemplarily arranged on a rear pane 14 of a vehicle 16.

FIG. 2 shows a schematic top view of a vehicle 16 with two antenna arrangements according to the invention 1. The two antenna arrangements 1 are arranged in the area of the rear pane 14 of vehicle 16. In particular, the respective housings 4 of the impedance converters 2 are integrated in C-pillars of the vehicle 16, the second antenna structures 10 being arranged on both sides of the rear pane 14 and being connected via electrical lines 12 to the respective third electronic circuits which are arranged within a respective housing 4 of a respective impedance converter 2.

The invention claimed is:

1. An antenna arrangement for a vehicle, the antenna arrangement comprising:

a housing configured to house an impedance converter and a first electronic circuit, wherein the first electronic circuit is configured to passively or actively match an impedance and amplify a signal of a broadcasting antenna having at least one electrical input and at least one electrical output;

a first antenna structure attached to or located in the housing;

a second electronic circuit located in the housing, wherein the second electronic circuit is coupled to the first antenna structure and is configured to control the first antenna structure;

a second antenna structure arranged outside the housing; and a third electronic circuit located in the housing, wherein the third electronic circuit is connected to the second antenna structure using an electrical line and is configured to control the second antenna structure.

2. The antenna arrangement according to claim 1, wherein the second antenna structure is arranged on or in a pane of the vehicle.

3. The antenna arrangement according to claim 2, wherein the second antenna structure is a film and is arranged in areas on the pane of the vehicle or is integrated into the pane of the vehicle.

4. The antenna arrangement according to claim 1, wherein the second antenna structure is a film and is integrated in areas in a body part of the vehicle or is arranged on the body part of the vehicle.

5. The antenna arrangement according to claim 1, wherein the first antenna structure and the second antenna structure are designed or configured to different frequencies.

6. The antenna arrangement according to claim 5, wherein the first antenna structure is configured to receive high frequencies and the second antenna structure is configured to receive low frequencies.

7. The antenna arrangement according to claim 1, wherein the first antenna structure and the second antenna structure comprise radio antennas.

8. The antenna arrangement according to claim 1, in which the at least one first antenna structure is integrated in a wall of the housing.

9. The antenna arrangement according to claim 1, wherein the impedance converter is arranged in a front area of the vehicle or in a rear area of the vehicle.

10. The antenna arrangement according to claim 1, wherein the first antenna structure is a film wrapped around the housing.

11. The antenna arrangement according to claim 1, wherein the first antenna structure is integrated into a wall of the housing.

12. The antenna arrangement according to claim 1, wherein the second electronic circuit and the first antenna structure are arranged on the first electronic circuit.

13. A vehicle, comprising:

an antenna arrangement comprising:

a housing configured to house an impedance converter and a first electronic circuit, wherein the first electronic circuit is configured to passively or actively match an impedance and amplify a signal of a broadcasting antenna having at least one electrical input and at least one electrical output;

a first antenna structure attached to or located in the housing;

a second electronic circuit located in the housing, wherein the second electronic circuit is coupled to the first antenna structure and is configured to control the first antenna structure;

a second antenna structure arranged outside the housing; and a third electronic circuit located in the housing, wherein the third electronic circuit is connected to the second antenna structure using an electrical line and is configured to control the second antenna structure.

* * * * *